United States Patent [19]

Kubota

[11] 4,221,325

[45] Sep. 9, 1980

[54] COOLING STRUCTURE FOR A CENTRIFUGE

[75] Inventor: Tokihito Kubota, Tokyo, Japan

[73] Assignee: Kabushiki Kaisha Kubota Seisakusho, Tokyo, Japan

[21] Appl. No.: 15,685

[22] Filed: Feb. 27, 1979

[30] Foreign Application Priority Data

Mar. 13, 1978 [JP] Japan ..... 53-32566[U]

[51] Int. Cl.[3] ..... B04B 15/02

[52] U.S. Cl. ..... 233/26; 233/11

[58] Field of Search ..... 233/26, 11, 1 R, 13

[56] References Cited

U.S. PATENT DOCUMENTS

| | | | |
|---|---|---|---|
| 2,699,289 | 1/1955 | Allen | 233/26 |
| 2,854,189 | 9/1958 | Garrett | 233/11 |
| 2,878,992 | 3/1959 | Pickels | 233/11 |
| 2,917,229 | 12/1959 | Benedetto | 233/11 |

*Primary Examiner*—Robert W. Jenkins

*Attorney, Agent, or Firm*—Pollock, Vande Sande and Priddy

[57] ABSTRACT

In a centrifuge in which a truncated-cone-shaped angle rotor is disposed in an outer casing and driven by a motor disposed in the outer casing and a plurality of sample tube containers are mounted in the angle rotor to extend radially along its peripheral surface, an air guide is provided for guiding air from the outside of the outer casing to the peripheral surface of the angle rotor, by which the air thus guided flows down the peripheral surface of the angle rotor to cool it.

13 Claims, 13 Drawing Figures

COOLING STRUCTURE FOR A CENTRIFUGE

BACKGROUND OF THE INVENTION

This invention relates to a centrifuge in which the so-called angle rotor carrying a sample is driven at high speed for sedimentation, separation or the like of the sample, and more particularly to a centrifuge cooling arrangement which is designed so that air is drawn into a centrifuge from the outside and directed around a rotor to cool it.

In a centrifuge, a rotor carrying a sample is driven at high speed for separation, sedimentation or the like of the sample. The high-speed revolution of the rotor causes heat generation by friction between the rotor and air to heat the former; and this may in some cases lead to a temperature rise of the sample to decompose it and exert a bad influence on the analysis of the sample. To avoid this, the rotor must be cooled.

In the case of employing the so-called angle rotor, since it takes the form of a truncated cone and has a relatively large peripheral surface area, air on its peripheral surface is blown off downwardly by the rotation of the rotor, causing a decrease in the air pressure in the vicinity of the center of rotation of the rotor on the top thereof. With the provision of an air inlet in a lid of the centrifuge adjacent the center of rotation of the rotor on the top thereof, air is drawn from the outside through the inlet to flow down on the peripheral surface of the rotor while absorbing therefrom heat to cool it. The heat absorbing air is released to the outside from an outer casing of the centrifuge. In the prior art, the rotor is cooled by such a method utilizing the phenomenon caused the rotation of the rotor. With such a cooling arrangement, the rotor can be easily cooled without the necessity of providing a cooling device separately of the centrifuge, and consequently the centrifuge itself can be made small and inexpensive.

In the above centrifuge, however, sample tubes are mounted in the rotor to extend along its peripheral surface and radially of its center of rotation, with the upper end portions of the sample tubes slightly projecting out of the top of the rotor and left open; that is, the upper open ends of the sample tubes lie adjacent the aforesaid air inlet made in the lid. Consequently, floating matter or dust in the air flowing through the air inlet may in some cases get mixed into the sample to exert a bad influence thereon, introducing inaccuracy in the result of inspection.

The sample tubes may also be capped to prevent such floating matter from mixing into the sample, but it is very troublesome to attach a cap to each sample tube and the cap is very likely to be blown off by centrifugal force because of the high-speed revolution of the rotor; therefore, the sample tubes are usually left open. Further, since the upper open end portions of the sample tubes project out of the top of the rotor, as referred to above, the projecting portions of the sample tubes disturb the air stream from the air inlet to prevent the air from smoothly flowing down the peripheral surface of the rotor; turbulence is produced in the air flow to make harsh noises. Further, the turbulent flow of air lowers the air drawing efficiency.

An object of this invention is to provide a cooling structure for centrifuges of the type employing an angle rotor and cooling it by drawing air from the outside which is designed so that even if sample tubes are not capped while in use, floating matter in air hardly gets mixed in a sample to ensure an accurate inspection of the sample.

Another object of this invention is to provide a cooling structure for centrifuges of the type employing an angle rotor and cooling it by automatically drawing air from the outside which is designed so that an air flow drawn from the outside is not disturbed by sample tubes and flows smoothly without swirling, thereby preventing noise generation and providing for enhanced air drawing efficiency.

SUMMARY OF THE INVENTION

In the centrifuge of this invention, a substantially truncated-cone shaped angle rotor is housed in an outer casing and containers for sample tubes are mounted in the angle rotor along its peripheral surface and radially of its axis, as in the prior art. Further, a motor for driving the angle rotor is mounted in the outer casing. In this invention, an air guide is provided for directing air from the outside of the outer casing to the peripheral surface of the angle rotor. For example, the air guide is contiguous at one end to a hole formed in the outer casing and has at the other end a tubular member facing the peripheral surface of the angle rotor. It is preferred that the tubular member be disposed opposite as high a portion of the peripheral surface of the rotor as possible. In the space between the tubular member and the angle rotor, air is blown off by the rotation of the angle rotor to make the air pressure there lower than the outside air pressure, causing an air flow into the outer casing through the air guide.

In this manner, the air guide directs the air from the outside to the peripheral surface of the angle rotor but, unlike in the prior art, does not guide the air towards the top of the angle rotor; therefore, the air does not flow towards the open ends of the sample tubes and there is no likelihood of floating matter in the air getting mixed in the samples contained in the sample tubes. Further, as the air thus drawn in the outer casing does not flow towards the upper end portions of the sample tubes projecting out of the angle rotor, the air flow is not disturbed by them, and consequently neither turbulence nor noises are produced and the air drawing efficiency is high.

By providing silencer means in the air guide, it is possible to prevent roaring of a motor and noises from being heard outside through the air guide. A filter may also be provided in the air guide for removing floating matter in the air to be drawn from the outside. The silencer means and the filter may also be formed as a unitary structure for performing both functions.

The air guide may take a tubular form but may also be arranged as follows: Namely, the air guide is attached, for example, to the inside of a lid of the centrifuge and a circular hole is made in the end face of the guide on the opposite side from the lid to open to the vicinity of the upper portion of the peripheral surface of the angle rotor on the outside of the area where the upper end portions of a plurality of sample tubes are arranged. Opposite to the central portion of the air guide, a hole is made in the lid of the centrifuge, from which hole the air flows to the peripheral surface of the angle rotor through the air guide and its circular hole.

DESCRIPTION OF THE PREFERRED EMBODIMENTS

Figure 1:
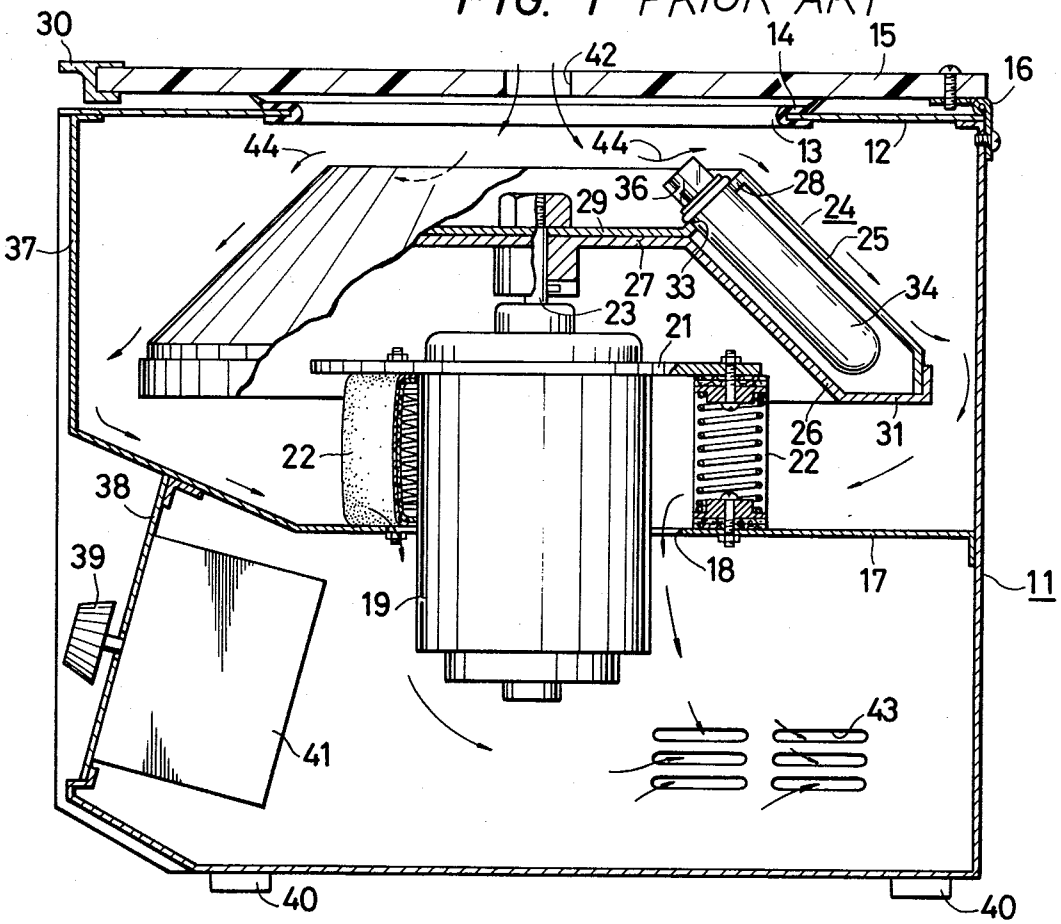
FIG. 1 PRIOR ART
FIG. 1 is a cross-sectional view showing a conventional cooling structure for centrifuges.

To facilitate a better understanding of this invention, a description will be made first of an example of a conventional centrifuge cooling arrangement with regard to FIG. 1. An outer casing 11 is, for instance, substantially rectangular in shape and has a relatively large circular opening 13 in its top panel 12. A ringshaped packing 14 made of an elastic material, such as rubber, is secured to the inner marginal edge of the circular opening 13 to extend along it. A lid 15 is attached to one marginal edge of the top panel 12 in a manner to be pivotal about a hinge 16 to cover the opening 13. On the inside of the outer casing 11 is attached substantially horizontally a support panel 17, which has a large centrally disposed circular hole 18 for receiving a motor 19. The motor 19 is seated in the hole 18, with a flange 21 extending from the periphery of a bracket of the motor 19 disposed on the side of the top panel 12 with respect to the support panel 17, and the motor 19 is supported on the support panel 17 by vibration-isolating support members 22 interposed between the flange 21 and the support panel 17. A rotary shaft 23 of the motor 19 extends vertically to project towards the lid 15 and an angle rotor 24 is affixed to the projecting end portion of the rotary shaft 23.

The angle rotor 24 is composed of a truncated-cone shaped outer wall plate 25 with the rotary shaft 23 as its axis and a similarly truncated-cone shaped inner wall plate 26 disposed inside of the outer wall plate 25 in a certain spaced relation thereto. The upper open end of the inner wall plate 26 is closed by a coupling plate 27, and the marginal portion of the outer wall plate 25 on the side of the top panel 12 is bent inwardly to form a sample support 28. The inner marginal edge of the sample support 28 is contiguous to a coupling plate 29, which is placed on and fixed to the coupling plate 27. The coupling plates 27 and 29 respectively have centrally disposed holes for receiving the rotary shaft 23, to which the rotor 24 is demountably affixed. The lower marginal portion of the inner wall plate 26 is bent outwardly to form a bottom plate portion 31, whose outer marginal portion is, in turn, bent upwards for close engagement with the lower peripheral surface of the outer wall plate 25.

In the sample support 28 of the angle rotor are formed a plurality of holes 33 spaced an equal distance apart, and containers 34 for sample tubes are inserted and fixedly seated in the holes 33. The containers 34 are disposed to extend along the interior surface of the outer wall plate of the angle rotor 24 and radially of the rotor axis. In the containers 34, sample tubes 36 are respectively inserted and held. The containers 34 are made, for example, of a metal, while the sample tubes are generally formed of glass or synthetic resin.

On the lower half portion of a front panel 37 of the outer casing 11 is provided an operation panel 38, on which are disposed an operation knob 39 and so on (not shown) and on the inside of which is mounted a drive control unit 41. By the knobs on the operation panel 38 are achieved on-off control of a power source switch, driving of the motor, setting of the time for the motor drive, etc. At the edge of the lid 15 on the opposite side from the hinge 16, a grip 30 is provided for opening and closing the lid 15. To the underside of the outer casing 11 are attached legs 40 made of rubber.

The lid 15 has formed therein a small air inlet 42 at the central portion substantially in alignment with the rotary shaft 23 of the motor 19. Exhaust ports 43 are formed in the lower portion of one side panel of the outer casing 11.

Upon rotation of the rotor 24 driven by the motor 19, air on the peripheral surface of the rotor 24 is blown off by the centrifugal force outwardly along the peripheral surface of the rotor 24. As a consequence, the air pressure on the top of the rotor 24 around its center is reduced, that is, the air pressure in the space under the air inlet 42 lowers to draw air into the outer casing 11 from the outside through the air inlet 42. The air thus drawn flows down along the peripheral surface of the rotor 24 to absorb its heat and passes through the circular hole 18 in the support panel 12 and is then released to the outside through the exhaust ports 43, as indicated by arrows. In this manner, cooling of the rotor 24 is automatically achieved by the rotation of the rotor itself without any particular forced cooling. With this arrangement, the centrifuge can be produced at a low cost.

The sample tubes 36 mounted in the rotor 24 are left open while in use and are exposed directly to the air stream from the air inlet 42, so that floating matter in the air may in some cases get mixed in the samples to affect their inspection results. Further, the sample tubes 36 partly project out of the rotor 24 and disturb the air stream to produce therein turbulence, making harsh noises and decreasing the air drawing efficiency.

Figure 2:
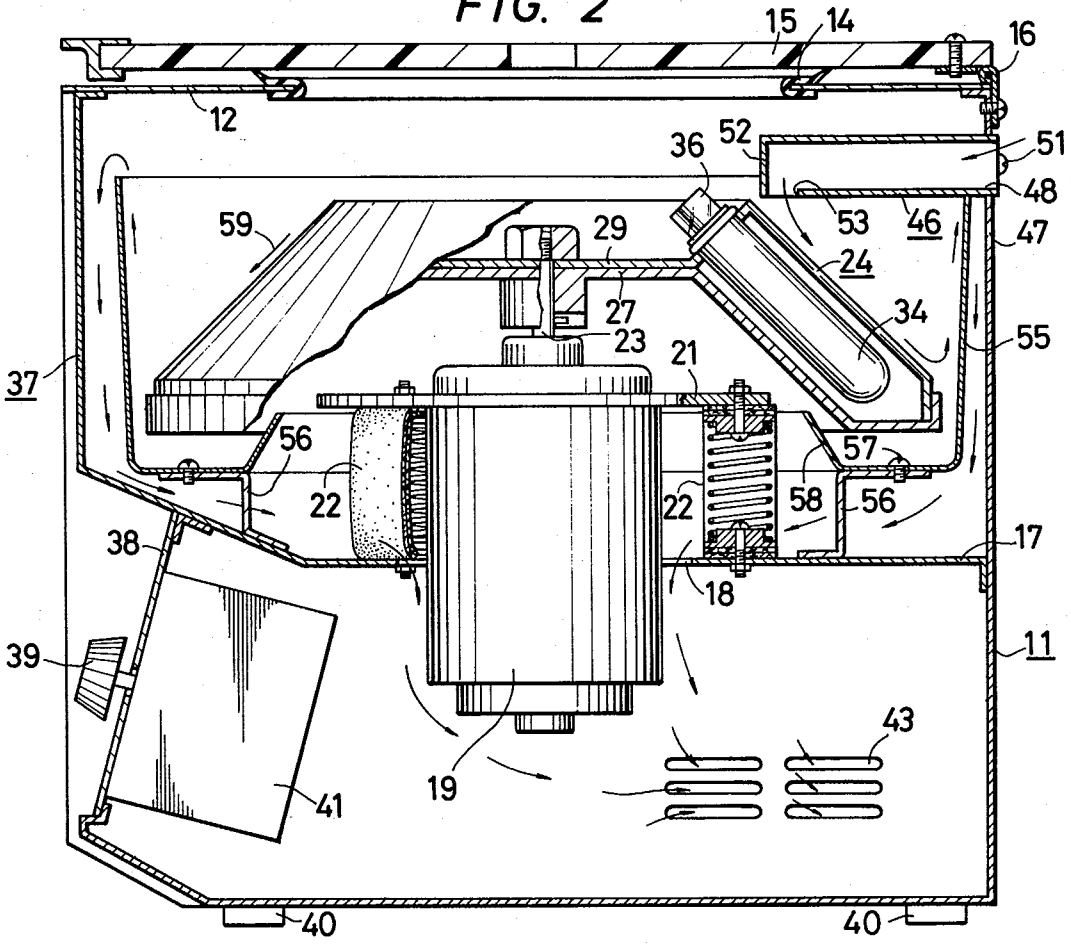
FIG. 2 is a cross-sectional view showing an example of a centrifuge cooling structure according to this invention.
Figure 3:
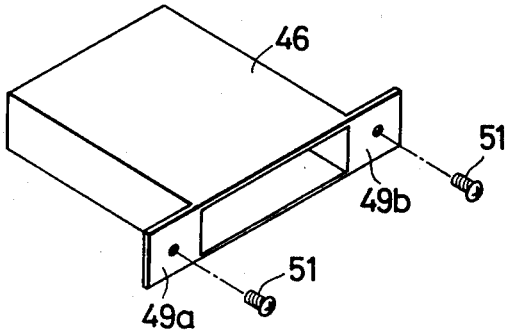
FIG. 3 is a perspective view showing the air guide employed in FIG. 2.

FIG. 2 illustrates an example of the centrifuge cooling arrangement of this invention, in which parts corresponding to those in FIG. 1 are identified by the same reference numerals. In the present invention, an air guide 46 is provided for guiding air from the outside of the outer casing 11 to the peripheral surface of the rotor 24. In the illustrated embodiment, the air guide is shown to have a tubular configuration of a rectangular cross section and one end thereof is detachably fitted into a hole 48 made in the upper portion of a rear panel 47 of the outer casing 11. An example of the air guide is shown in FIG. 3, in which both sides of one opening of a rectangular tubular member are bent outwardly to form adapter plate portions 49*a* and 49*b*, which are fixed to the rear panel 47 by means of screws 51. As shown in FIG. 2, the air guide 46 is disposed substantially in a lateral direction, that is, in a horizontal direction, with its inner end portion lying opposite the peripheral surface of the rotor 24 in the vicinity of the upper edge of the rotor. The inner end face of the air guide 46 is closed with an end plate 52 and a slot 53 is formed in the bottom of the air guide 46, that is, in its inner end portion facing towards support panel 17. The slot 53 faces the upper area of the peripheral surface of the rotor 24 and directs thereto an air stream from the outside.

In this embodiment, an inner housing 55 is disposed above the support panel 17 in the outer casing 11 and the rotor 24 is mounted in the inner housing 55. The inner housing 55 is removably attached at its bottom to a fixture 56 of the support panel 17 by means of screws 57. There is defined a gap between the inner housing 55 and the outer casing 11. The bottom plate of the inner housing 55 has made therein a large opening, in which the motor 19 is positioned. The inner marginal portion of this opening is bent back to approach and extend along the lower end portion of the inner wall of the rotor 24. The inner housing 55 is made, for example, of synthetic resin and designed to receive samples spilled or blown off from sample tubes so that such samples do not fly about in the outer casing 11. In other words, the inner housing 55 prevents spilled samples from soiling the outer casing 11 to rust it. The inner housing can be disassembled from the outer casing 11 for exchange with a new one, as needed. In such a case, the air guide 46 is taken out of the outer casing 11 by removing the screws 51, and the top panel 12 and the rotor 24 are also removed, after which the inner housing 55 can be removed.

With the arrangement shown in FIG. 2, the air on the rotor 24 is blown off by the rotation of the rotor 24 to flow down its peripheral surface, causing a decrease in the air pressure in the neighborhood of the upper marginal portion of the peripheral surface of the rotor 24. Since the air outlet 53 of the air guide 46 is opposite the space where the air pressure is decreased, air is drawn into the outer casing 11 through the air guide 46. The air thus drawn flows down the peripheral surface of the rotor 24, rises up along the inner peripheral surface of the inner housing 55 and flows down again between the inner housing 55 and the outer casing 11 and then passes through the circular hole 18 to the underside of the outer casing 11, thereafter being discharged from the outer casing 11 through the exhaust ports 43, as indicated by arrows. When the air drawn from the outside flows down the peripheral surface of the rotor 24, it absorbs heat from the rotor 24 to cool it.

With the cooling arrangement shown in FIG. 2, the air drawn from the outside passes over the peripheral surface of the rotor 24 but does not flow along its top, so that the air does not flow towards the upper end portions of the sample tubes 36. Consequently, there is no danger of floating matter in the air getting mixed in the samples contained in the sample tubes 36. Further, since the cooling air does not flow towards the upper end portions of the sample tubes projecting out from the rotor 24, as mentioned above, the air stream from the outside is not likely to be disturbed by the projecting portions of the sample tubes 36. Therefore, the air stream neither swirls nor makes noises. In addition, as the air stream flows smoothly without being disturbed, the air drawing efficiency is high.

Figure 4:
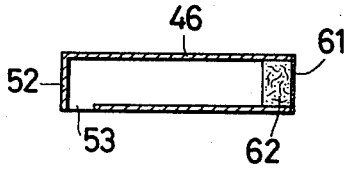
FIG. 4 is a cross-sectional view illustrating an example of the air guide provided with a filter.
Figure 5:
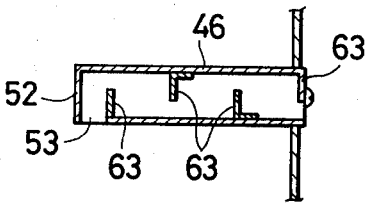
FIG. 5 is a cross-sectional view showing a modified form of the air guide which is provided with silencer means.

As shown in FIG. 4, a wire gauze 61 can be attached to the air guide 46, for example, at its outer open end face so as to prevent floating matter in air from being drawn into the inner housing 55; and in place of the wire gauze 61, a filter such, for example, as sponge 62 or the like, may also be stuffed in the air guide 46. Further, as shown in FIG. 5, it is also possible to attach a plurality of ribs 63 to the top and bottom inner walls of the air guide 46 at proper intervals to extend at right angles to the air flow so that noises inside of the outer casing 11 may not be heard outside through the air guide 46.

Figure 6:
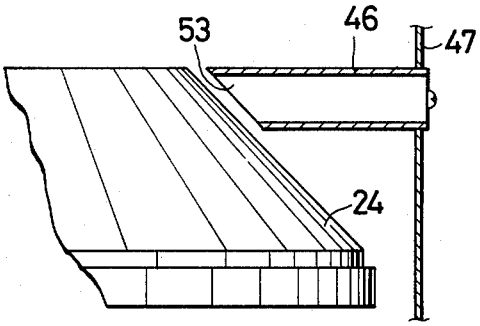
FIG. 6 is a cross-sectional view illustrating another modified form of the air guide in which its inner end face is opened adjacent the peripheral surface of a rotor.
Figure 7:
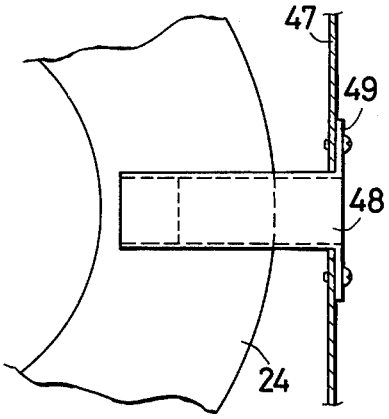
FIG. 7 is a plan view of the air guide of FIG. 6.
Figure 8:
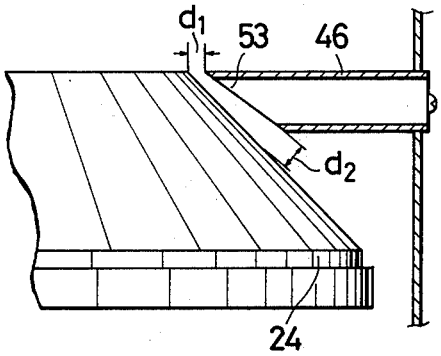
FIG. 8 is a cross-sectional view showing another modified form of the air guide in which its inner end face is formed to extend along the peripheral surface of the rotor.
Figure 9:
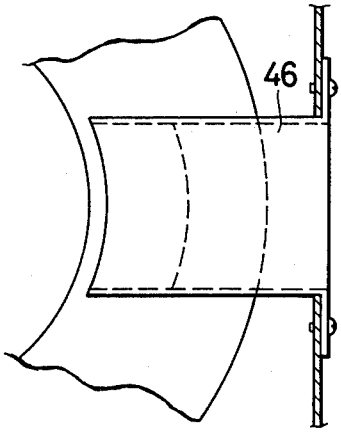
FIG. 9 is a plan view of the air guide of FIG. 8.

FIGS. 6 and 7 illustrate another example of the air guide 46 whose inner end portion is opened and cut at an angle so that the inner open end conforms to the slope of the peripheral surface of the rotor 24. FIGS. 8 and 9 show a modified form of the air guide of FIGS. 6 and 7, in which the inner open end conforms to the peripheral surface of the rotor 24 in its circumferential direction, too. In this case, it is preferred to select the distance $d_2$ between the lower edge of the inner end of the air guide 46 and the rotor 24 to be larger than the distance $d_1$ between the upper edge of the inner end of the air guide 46 and the rotor 24 so that the air on the peripheral surface of the rotor 24 easily flows downwards by the rotation of the rotor 24. In the above, the air guide 46 is mounted on the side panel of the outer casing 11, i.e. a vertical panel, but may also be attached, for example, to the top panel 12. In this latter case, the air guide 46 is secured at one end to the top panel 12 to extend downwards, whereby to guide the sucked air to the peripheral surface of the rotor 24 from above.

Figure 10:
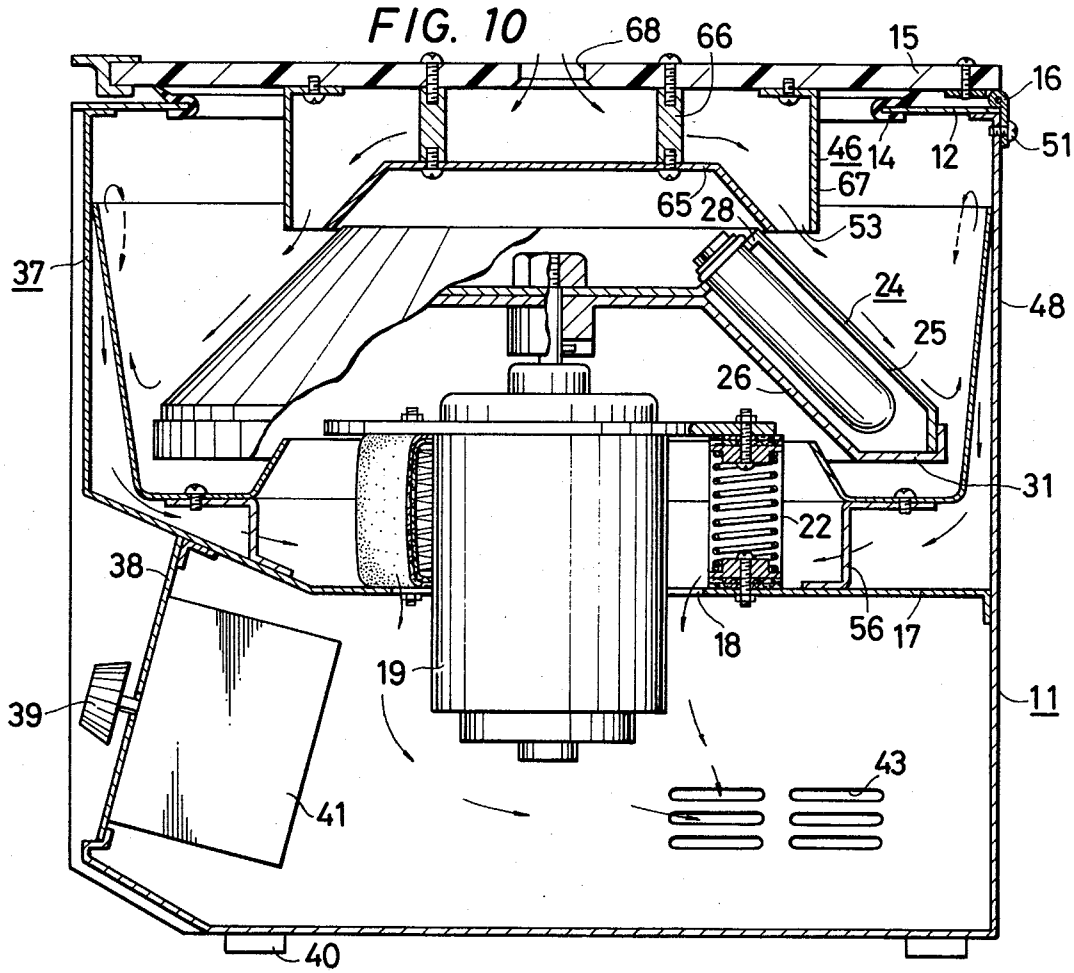
FIG. 10 is a cross-sectional view illustrating another example of the centrifuge cooling structure of this invention in which the air guide is attached to a cover of a centrifuge.

Further, the air guide 46 may also be attached to the lid 15, as depicted in FIG. 10. In this case, the air guide 46 is composed of a cylindrical member 67 mounted on the underside of the lid 15 coaxially with the rotor 24 and a bottom plate 65 disposed on the side of the rotor 24. The bottom plate 65 is shown to be attached by pins 66 to the lid 15. The marginal portion of the bottom plate 65 is sloped down to approach the rotor 24 as it approaches the cylindrical member 67. A ring-shaped air outlet 53 of the air guide 46 is defined between the lower edges of the bottom plate 65 and the cylindrical member 67. The air outlet 53 has a diameter a little larger than that of the top of the rotor 24 and is substantially flush therewith. An air intake 68 is formed in the central portion of the lid 15 on which the air guide 46 is mounted.

When the air on the peripheral surface of the rotor 24 is blown off by the rotation of the rotor 24 to lower the air pressure on its top, the air in the air guide 46 flows to the peripheral surface of the rotor 24 through the ring-shaped air outlet 53, and air from the outside is drawn into the air guide 46 through the air intake 68 and then led to the outer periphery of the rotor 24 through the air outlet 53, thus cooling the rotor 24. Also in this case, the air sucked from the outside does not flow towards the upper end portions of the sample tubes 36.

Figure 11:
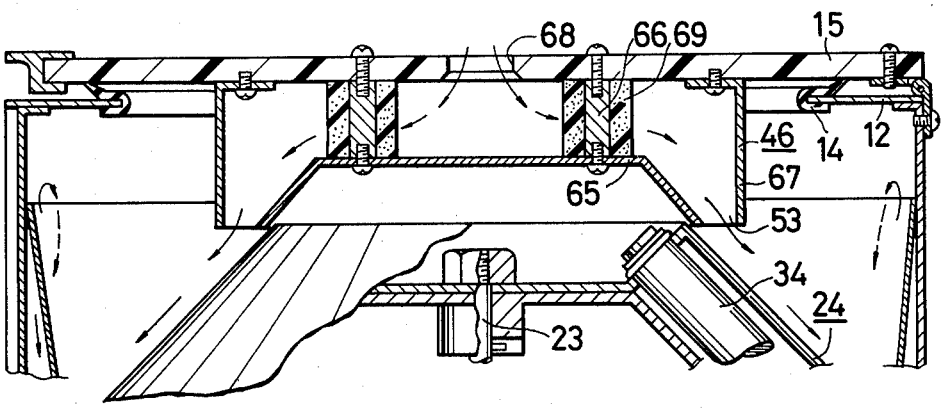
FIG. 11 is a cross-sectional view showing the principal part of a modification of the cooling structure of FIG. 10 in which a filter is provided in the air guide.
Figure 12:
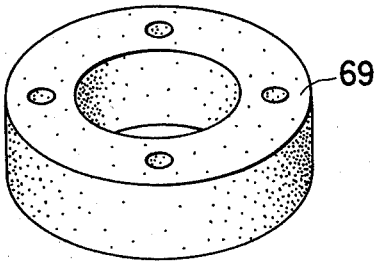
FIG. 12 is a perspective view showing an example of a filter 69 depicted in FIG. 11.
Figure 13:
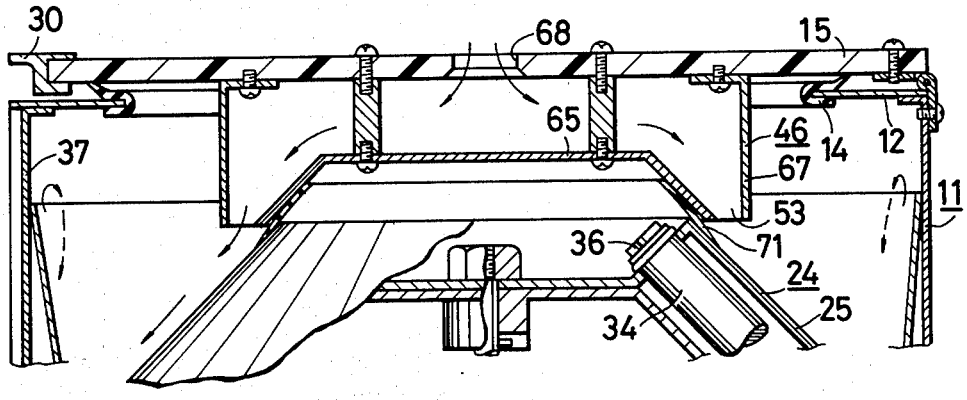
FIG. 13 is a cross-sectional view illustrating the principal part of another modification of the cooling structure of FIG. 11 in which the air guide is provided with a resilient sealing piece for contact with the rotor.

As shown in FIGS. 11 and 12, a cylindrical filter 69 made of a sponge may be disposed inside of the cylindrical member 67 coaxially therewith so as to remove floating matter in the suction air. In this example, the filter 66 is fixed by the pins 69 together with the bottom plate 65. As shown in FIG. 13, it is also possible to prevent an air flow to the side of the sample tubes 36 by attaching the inner marginal portion of an annular sealing member 71 as of rubber to the underside of the inclined marginal portion of the bottom plate 65 so that the outer marginal portion of the sealing member 71 makes elastic contact with the upper portion of the peripheral surface of the rotor 24. In this case, upon opening the lid 15, the air guide 46 and the sealing member 71 are automatically lifted off the rotor 24; therefore, there are neither need of capping each of the sample tubes 36 nor fear of the caps being blown off. In the case of mounting the air guide 46 on the lid 15, it is also possible to form the cylindrical member 67 and the bottom plate 65 as a unitary structure with each other and make a plurality of air outlets at the position of the air outlet 53 at equiangular intervals. In this case, the pins 66 can be omitted.

In the foregoing embodiments, the inner housing 55 need not always be provided. Further, the rotor 24 is not limited specifically to the illustrated one; for example, the inner wall plate 26 can be left out and the outer and inner wall plates 25 and 26 can be formed with metal plates or produced by molding of a synthetic resinous material. Moreover, it is also possible to employ a rotor made by cutting a block of metal into a truncated-cone-shaped structure and forming therein holes for receiving the containers 34, as is the case with conventional angle rotors. Such a rotor can also be produced by molding of a synthetic resinous material. Use can also be made of various other prior art angle rotors. A plurality of air guides 46 can also be attached to the outer casing 46 in the manner shown in FIG. 2 so that air is guided from the outside to the peripheral surface of the rotor 24 at a plurality of places spaced apart some angular distances with respect to the axis of the rotor 24.

It will be apparent that many modifications and variations may be effected without departing from the scope of novel concepts of this invention.

What is claimed is:

1. A cooling structure for a centrifuge comprising:
an outer casing;
a substantially truncated-cone-shaped angle rotor disposed in the outer casing;
a plurality of sample tube containers mounted in the angle rotor to extend radially along its peripheral surface, the upper ends of said sample tube containers being disposed in a circular locus at the upper end of said angle rotor and concentric with the axis of rotation of said rotor;
a motor disposed in the outer casing for driving the angle rotor; and
an air guide for guiding air from the outside of the outer casing to the peripheral surface of the angle rotor, said air guide having an air inlet end connected to an air inlet opening provided in said outer casing and having an air outlet end disposed adjacent the upper portion of the peripheral surface of said angle rotor at a position located radially outward of said circular locus.

2. A cooling structure for a centrifuge according to claim 1, wherein the air guide is provided with silencer means.

3. A cooling structure for a centrifuge according to claim 1, wherein the air guide is provided with a filter for removing floating matter in air flowing therethrough.

4. A cooling structure for a centrifuge according to claim 1, wherein the air guide is demountably mounted on the outer casing.

5. A cooling structure for a centrifuge according to claim 4, wherein the air guide is a tubular member which is attached to the outer casing to extend substantially horizontally, the air outlet end of said air guide being the inner end of said tubular member and the air inlet end of said air guide being the outer end of said tubular member which is fitted into a hole made in a side panel of the outer casing, the air guide being removable from the outer casing by pulling it out from the hole.

6. A cooling structure for a centrifuge according to claim 5, wherein the inner end face of the air guide is open, and wherein the open end face is inclined to extend substantially along the slope of the peripheral surface of the angle rotor.

7. A cooling structure for a centrifuge according to claim 6, wherein the distance between the lower edge of the inner open end face of the air guide and the peripheral surface of the angle rotor is larger than the distance between the upper edge of the inner open end face of the air guide and the peripheral surface of the angle rotor.

8. A cooling structure for a centrifuge according to claim 5, wherein the inner end portion of the air guide is opened in its bottom.

9. A cooling structure for a centrifuge according to claim 5, wherein the inner end face of the air guide is formed to extend along the peripheral surface of the angle rotor in its circumferential direction.

10. A cooling structure for a centrifuge according to claim 1, wherein the air guide is mounted on the inside surface of a lid attached to the outer casing.

11. A cooling structure for a centrifuge according to claim 1, wherein the air guide is a flat cylindrical member having a bottom plate substantially coaxial with the rotary shaft of the angle rotor, the cylindrical air guide being attached at its top to the inside surface of a lid on said outer casing, wherein an air intake is made in the lid at the center of the area surrounded by the air guide, and wherein an annular air outlet is made in the bottom plate of the air guide coaxially therewith to face the upper portion of the peripheral surface of the angle rotor.

12. A cooling structure for a centrifuge according to claim 1, wherein the air guide is a flat drum-shaped member having a bottom plate coaxial with the angle rotor, the flat drum-shaped member being attached at its top to a lid on said outer casing, and wherein a plurality of air outlets are formed in the bottom plate about its axis at substantially equiangular distances, the plurality of air outlets being adjacent the upper portion of the peripheral surface of the angle rotor.

13. A cooling structure for a centrifuge according to claims 11 or 12, wherein an annular sealing member of an elastic material is fixed at its inner marginal edge to the bottom plate on the inside of the air outlets, the outer marginal edge of the sealing member being in elastic contact with the upper portion of the peripheral surface of the angle rotor.

* * * * *